US006197733B1

(12) United States Patent
Mikami et al.

(10) Patent No.: US 6,197,733 B1
(45) Date of Patent: Mar. 6, 2001

(54) PHOTORESIST ASHING RESIDUE CLEANING AGENT

(75) Inventors: Ichiro Mikami; Yoshifumi Yamashita; Toru Nonaka, all of Tokuyama (JP)

(73) Assignee: Tokuyama Corporation, Yamaguchi-ken (JP)

( * ) Notice: Subject to any disclaimer, the term of this patent is extended or adjusted under 35 U.S.C. 154(b) by 0 days.

(21) Appl. No.: 09/392,244

(22) Filed: Sep. 9, 1999

(30) Foreign Application Priority Data

Sep. 9, 1998 (JP) ..... 10-254740
Dec. 28, 1998 (JP) ..... 10-373463

(51) Int. Cl.[7] ..... C11D 9/04; C11D 15/00; B08B 6/00

(52) U.S. Cl. ..... 510/175; 510/176; 510/490; 134/1.3

(58) Field of Search ..... 510/175, 176, 510/490; 134/1.3

(56) References Cited

U.S. PATENT DOCUMENTS 5,759,973 * 6/1998 Honda et al. ..... 510/176
5,792,274 * 8/1998 Tanabe et al. ..... 134/1.3
5,905,063 * 5/1999 Tanabe et al. ..... 510/176

* cited by examiner

*Primary Examiner*—Yogendra Gupta
*Assistant Examiner*—John M. Petruncio

(57) ABSTRACT

A photoresist ashing residue cleaning agent used after the ashing of the photoresist in the production of a semiconductor circuit pattern. The photoresist ashing residue cleaning agent comprises an aqueous solution containing:

a) an ammonium fluoride compound; and b) an amphoteric surfactant of which the cationic group is an ammonium salt and of which the anionic group is a carboxylate.

12 Claims, No Drawings

PHOTORESIST ASHING RESIDUE CLEANING AGENT

BACKGROUND OF THE INVENTION

1. Field of the Invention

The present invention relates to a photoresist ashing residue cleaning agent used after the ashing of the photoresist in the production of a semiconductor circuit pattern.

2. Description of the Prior Art

Elements such as ICs and LSIs on a semiconductor wafer are generally produced by forming fine electronic circuit patterns on a substrate wafer relying upon the photolithography technology. Concretely speaking, a photoresist is applied onto the substrate wafer on which are formed an insulating layer such as an $SiO_2$ layer and an electrically conducting layer of a metal such as Al, Cu, Si, Ti, etc. or an alloy thereof, which is, then, developed by exposure to light through a mask on which is formed a desired pattern to form a resist pattern on a desired portion. Then, the treatment such as etching is effected for the insulating layer and the electrically conducting layer from the upper side of the resist pattern, and the resist is, then, removed. In forming the semiconductor circuit pattern as described above, the photoresist has heretofore been removed by using a photoresist remove solution comprising various organic solvents.

In recent years, however, there has generally been employed a method of removing the photoresist by the so-called ashing treatment according to which the photoresist is removed by being ashed utilizing the energy of plasma, in order to precisely remove the photoresist after having formed a fine resist pattern, featuring simple operation yet meeting the demand for forming circuit patterns maintaining precision. On the surface from where the photoresist is removed by ashing treatment, however, there remain the incompletely ashed product of photoresist and the side-wall polymer formed in the step of etching without being removed to a sufficient degree through the above-mentioned treatment.

Here, the side-wall polymer is a low solubility product formed on the side walls of the photoresist mask in the step of etching as a result of a complex reaction of an etching gas with the photoresist or with the underlying electrically conducting layer, insulating layer and substrate. The side-wall polymer may often be intentionally formed in order to enhance the effect of anisotropic etching or may be formed unintentionally. When the reactive ion etching (RIE) is conducted, the side-wall polymer and the incompletely ashed product of photoresist may exhibit particularly low solubility. The RIE is a method according to which a negative voltage is applied to the wafer which is a substrate, a reactive gas containing a halogen gas such as of carbon fluoride, hydrogen fluoride or hydrogen chloride is irradiated with a plasma to etch the layer that is to be treated, and has in recent years been chiefly employed as a dry etching featuring excellent anisotropy.

The photoresist to be removed by the ashing treatment may be degenerated when it is exposed to the ion-implantation treatment. After the ashing treatment, therefore, the incompletely ashed product of photoresist is formed to a conspicuous degree. The ion-implantation treatment is the operation for implanting ions of phosphorus, boron, arsenic, indium, antimony or titanium in order to form an electrically conducting portion at a desired place in the insulating substrate wafer while masking the surface thereof with a resist pattern.

The incompletely ashed product of photoresist and the side-wall polymer (hereinafter they are referred to as photoresist ashing residue or simply ashing residue) remaining on the surface from where they are removed after the ashing treatment, could cause defective contact to the interconnection and must, hence, be removed by washing. Therefore, the solution comprising various organic solvents such as those used as the above-mentioned photoresist remove solution, has been used as a cleaning agent to remove the residue. In fact, however, the photoresist ashing residue has been polymerized to a high degree and is becoming inorganic to a considerable degree, and dissolves little in an organic solvent, and cannot be removed with these cleaning agents to a sufficient degree.

Under such circumstances, Japanese Unexamined Patent Publication (Kokai) No. 197681/1997 discloses a composition comprising a fluoride such as ammonium fluoride, a water-soluble organic solvent and water as a cleaning agent for the above-mentioned photoresist ashing residue. Owing to the action of the fluoride and water, this composition is capable of dissolving and removing the ashing residue considerably favorably. It is, however, demanded to further enhance the dissolving power to dissolve the residue having low solubility, such as the side-wall polymer formed by the RIE and the incompletely ashed product of photoresist degenerated by the ion-implanting treatment. However, when the amount of use of the organic solvent is decreased to render it to be highly inorganic such that the cleaning agent exhibits further enhanced dissolving power for the photoresist ashing residue, the underlying electrically conducting layer and insulating layer may be corroded by the cleaning treatment causing a serious problem.

It has therefore been desired to develop a photoresist ashing residue cleaning agent capable of favorably removing the photoresist ashing residue such as incompletely ashed product of photoresist and side-wall polymer, causing the insulating layer and the electrically conducing layer on the substrate wafer to be little corroded.

SUMMARY OF THE INVENTION

The object of the present invention is to provide a novel photoresist ashing residue cleaning agent.

Another object of the present invention is to provide a photoresist ashing residue cleaning agent capable of favorably removing the photoresist ashing residue such as incompletely ashed product of photoresist and side-wall polymer and, particularly, the incompletely ashed product of photoresist degenerated by the ion-implantation treatment and the side-wall polymer formed by the RIE.

A further object of the present invention is to provide a photoresist ashing residue cleaning agent which little corrodes the insulating layer and the electrically conducting layer on the substrate wafer.

These objects of the present invention can be accomplished by a photoresist ashing residue cleaning agent comprising an aqueous solution containing:

a) an ammonium fluoride compound; and b) an amphoteric surfactant of which the cationic group is an ammonium salt and of which the anionic group is a carboxylate.

DETAILED DESCRIPTION OF THE INVENTION

The photoresist ashing residue cleaning agent of the present invention comprises an aqueous solution of an ammonium fluoride compound. When dissolved in water and dissociated, the ammonium fluoride compound forms fluorine anions. Owing to the synergistic effect of fluorine anions and water which is a solvent, the cleaning agent of the present invention very favorably dissolves the low soluble photoresist ashing residue. Besides, since no metal is contained as a constituent element, the substrate wafer is not contaminated.

Here, the ammonium fluoride compound is the one represented by the general formula,

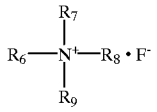

wherein $R_6$, $R_7$, $R_8$ and $R_9$ is, independently from each other, are a hydrogen atom or an alkyl group having 1 to 3 carbon atoms, such as primary, secondary, tertiary or quaternary ammonium salt in which anions are fluoride ions and a substituent constituting an ammonium salt is a lower alkyl group, in addition to ammonium fluoride. As the lower alkyl group constituting the ammonium salt, there can be exemplified a methyl group, an ethyl group or a propyl group having 1 to 3 carbon atoms.

Concrete examples of the ammonium fluoride compound preferably used in the present invention include ammonium fluoride; quaternary ammonium fluorides such as tetramethylammonium fluoride, tetraethylammonium fluoride, tetrapropylammonium fluoride, trimethyl ethylammonium fluoride, triethyl methylammonium fluoride, dimethyl diethylammonium fluoride, and dimethyl dipropylammonium fluoride; tertiary ammonium fluorides such as trimethylammonium fluoride and triethylammonium fluoride; secondary ammonium fluorides such as dimethylammonium fluoride and diethylammonium fluoride; and primary ammonium fluorides such as monomethylammonium fluoride and monoethylammonium fluoride. Among them, the most excellent compound is the ammonium fluoride. In the present invention, these ammonium fluoride compounds are used in two or more kinds in combination.

Though there is no particular limitation, it is desired that the concentration of the ammonium fluoride compound in the aqueous solution is from 0.005 to 1% by weight and, more preferably, from 0.01 to 0.8% by weight from the standpoint of favorably dissolving the ashing residue and corroding the underlayer little.

In the photoresist ashing residue cleaning agent of the present invention, the aqueous solution of the ammonium fluoride compound contains an amphoteric surfactant of which the cationic group is an ammonium salt and of which the anionic group is a carboxylate. As a result, excellent solubility for the photoresist ashing residue is not impaired, and the insulating layer and the electrically conducting layer are corroded very little with water. Here, the ammonium salt constituting the cationic group is a secondary to quaternary ammonium salt.

In the present invention, the amphoteric surfactant in which the cationic group is an ammonium salt and the anionic group is a carboxylate, is represented by the following general formula (I),

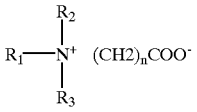

wherein $R_1$, $R_2$ and $R_3$ are, independently from each other, hydrogen atoms, hydrophobic groups, hydroxyl groups or amino groups, and at least one of $R_1$, $R_2$ and $R_3$ is a hydrophobic group, and when two or more of $R_1$, $R_2$ and $R_3$ are hydrophobic groups, these hydrophobic groups may be bonded to each other to form a ring, and n is an integer of from 1 to 3.

In the above-mentioned general formula, the hydrophobic group is an alkyl group having, preferably, from 1 to 20 carbon atoms, such as methyl group, ethyl group, propyl group, dodecyl group, nonyl group, octyl group, lauryl group, palmityl group or stearyl group; alkenyl group having, preferably, from 1 to 20 carbon atoms, such as vinyl group, allyl group, oleyl group, decyl group, or cis-9-hexadecyl group; acylamino group having, preferably, from 1 to 20 carbon atoms, such as acetylamino group, lauroylamino group or stearoylamino group; acylaminoalkyl group having, preferably, from 2 to 30 carbon atoms, such as palmitoylaminopropyl group, lauroylaminopropyl group or stearoylaminopropyl group; or alkylaminoalkyl group having, preferably, from 2 to 30 carbon atoms, such as octylaminoethyl group or palmitylaminopropyl group. These hydrophobic groups may have, as substituents, a small number of hydrophilic groups such as hydroxyl groups or amino groups within a range in which the hydrophobic property is not lost.

At least any one of $R_1$, $R_2$ or $R_3$ is particularly desired to be bonded by a strongly hydrophobic group having not less than 5 carbon atoms and, preferably, not less than 8 carbon atoms. When the hydrophobic group is bonded to form a ring, furthermore, it is desired that the member is a 5-membered ring or a 6-membered ring. It is further desired that n is usually 1.

Concrete examples of the amphoteric surfactant include lauryldimethylbetaine, nonyldimethylbetaine, dilaurylmethylbetaine, trioctylbetaine, decylenedimethylbetaine, cis-9-hexadecyldimethylbetaine, octylhydroxylmethylbetaine, laurylmethylaminobetaine, octylaminohydroxylbetaine, (lauroylamino) dimethylbetaine, (palmitoylaminopropyl)dimethylbetaine, di(palmitoylaminopropyl)methylbetaine, tri (palmitoylaminopropyl)betaine, (lauroylaminopropyl) dimethylbetaine, (hydroxyoctyl)dimethylbetaine, (hydroxylauryl)methylhydroxylbetaine, tri (palmitoylaminopropyl)betaine, (hydroxylauryl) dimethylbetaine, (hydroxylauryl)methylhydroxylbetaine, (octylaminoethyl)dimethylbetaine,

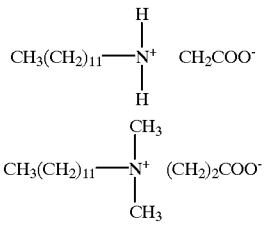

-continued

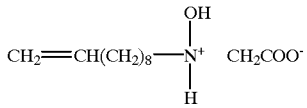

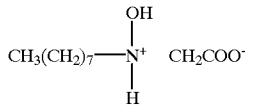

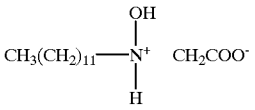

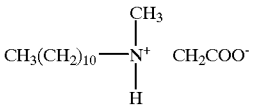

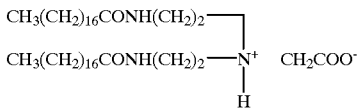

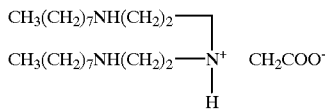

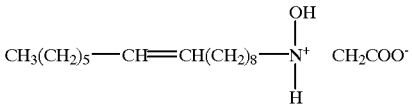

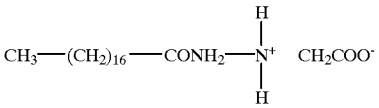

Further, examples in which two or more hydrophobic groups are bonded to form a ring include N-carboxymethyl-hydroxyethylimidazoliniunmethylbetaine, 2-propyl-N-carboxymethyl-hydroxyethylimidazoliniummethylbetaine and 2-methyl-carboxymethyl-N-hydroxyethylimidazoniummethylbetaine.

Among them, it is most desired to use the one represented by the formula,

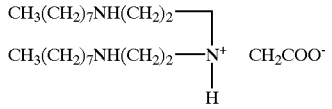

In the present invention, the amphoteric surfactants may be used in two or more kinds in combination.

Though there is no particular limitation, it is desired that the concentration of the amphoteric surfactant in the aqueous solution is from 0.005 to 1.5% by weight and, preferably, from 0.01 to 1% by weight from the standpoint of causing the underlayer to be little corroded, viscosity of the solution and easiness of after-rinse. In general, it is desired to increase the concentration of the amphoteric surfactant with an increase in the concentration of the ammonium fluoride compound.

The photoresist ashing residue cleaning agent of the present invention exhibits excellent effect in removing the photoresist ashing residue and in preventing the corrosion to the underlayer.

In order to further improve the effect, however, it is desired to blend the photoresist ashing residue cleaning agent with a fluorine-contained cationic surfactant. Upon being blended with the fluorine-contained cationic surfactant to further improve the properties, the photoresist ashing residue cleaning agent of the present invention exhibits the effect for favorably cleaning the substrate wafer for greatly extended periods of time.

The photoresist ashing residue cleaning agent comprising an aqueous solution containing the ammonium fluoride compound and the above-mentioned particular amphoteric surfactant, excellently removes the photoresist ashing residue. When a general substrate wafer that is ashed is immersed in the cleaning agent at a temperature of, for example, 23° C., therefore, the adhered ashing residue can, in many cases, be removed to a sufficient degree when about 10 minutes have passed after the immersion. Besides, the cleaning agent excellently prevents the corrosion to the underlying layer and, hence, causes the insulating layer and the electrically conducting layer to be corroded to only such a low degree that does not cause any practical problem unless the time after the substrate wafer was immersed does not exceed about 12 minutes. By using the photoresist ashing residue cleaning agent of the present invention, therefore, it is usually allowed to remove the photoresist ashing residue within a period of from about 10 to about 12 minutes after the immersion of the substrate wafer, accomplishing excellent cleaning performance yet suppressing the corrosion.

The cleaning time of this range does not impose any problem from the practical point of view. In order to further broaden the range of cleaning time and to improve the controllability in the cleaning time, it is desired to blend the cleaning agent with a fluorine-contained cationic surfactant as described above.

Here, the fluorine-contained cationic surfactant is a cationic surfactant having at least one carbon-fluorine bond at the hydrophobic moiety. Any known cationic surfactant can be used without limitation. Usually, however, there can be used an amine salt surfactant and a quaternary ammonium salt surfactant having a hydrophobic moiety. Particularly, there can be used the quaternary ammonium salt surfactant. The group constituting the hydrophobic moiety will be a fluorinated hydrocarbon group having 5 to 30 carbon atoms, such as fluoroalkyl group, fluoroalkenyl group or fluoroalkynyl group, or a group having a strong hydrophobic property including the fluorinated hydrocarbon group as a portion thereof.

Examples of the fluorinated hydrocarbon group include those of the form of a straight chain or a branched chain having 5 to 30 carbon atoms and, particularly, 6 to 20 carbon atoms, such as fluorooctyl group, fluorononyl group, fluorodecyl group or fluorolauryl group. The fluorinated hydrocarbon group that is highly fluorinated exhibits increased ability for removing the ashing residue. It is therefore desired that the fluorinated hydrocarbon group is perfluorinated. There is no particular limitation on the portion where the hydrophobic group and the hydrophilic group are bonded together, such as ester, ether, ketone, etc.

Though there is no particular limitation on the anions constituting the fluorine-contained cationic surfactant, there can be used halogen ions such as of chlorine, fluorine, bromine or iodine, or nitric acid ions or carbonic acid ions and, particularly, ions of iodine.

It is desired that the fluorine-contained cationic surfactant particularly desirably used in the present invention is represented by the following general formula,

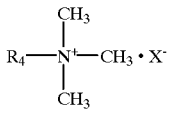

wherein $R_4$ is a perfluoroalkyl group and X- is an anion, or by the following general formula (III),

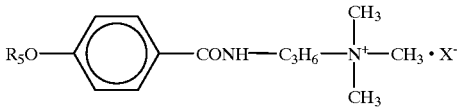

wherein $R_5$ is the same as $R_4$, and X- is an anion.

In the fluorine-contained cationic surfactant, it is desired that the perfluoroalkyl groups R4 and R5 have from 5 to 30 carbon atoms. Examples of the fluorine-contained cationic surfactant placed as products in the market will be "Ftargent FT-310" produced by Neos Co., "Fluorad FC-135" produced by Sumitomo 3M Co., "Surflon S-121" produced by Sei Chemical Co., "MEGAFAC F-150" produced by Dainippon Ink Co., etc.

According to the present invention, these fluorine-contained cationic surfactants may be used in two or more kinds in combination.

Though there is no particular limitation, it is desired that the concentration of the fluorine-contained cationic surfactant in the aqueous solution is from 0.005 to 0.5% by weight and, more preferably, from 0.01 to 0.1% by weight from the standpoint of preventing corrosion to the underlying layer, viscosity of the solution and easiness of after-rinse. In general, it is desired to increase the concentration of the fluorine-contained cationic surfactant with an increase in the concentration of the ammonium fluoride compound.

In the present invention, it is desired that the amphoteric surfactant and the fluorine-contained cationic surfactant are those from which the impurities have been removed to a sufficient degree through the purification. In particular, it is desired that the metal ions are contained in the cleaning agent in amounts of not larger than 100 ppb and, more preferably, not larger than 10 ppb.

In the present invention, the ammonium fluoride compound, amphoteric surfactant and fluorine-contained cationic surfactant are used in the form of an aqueous solution. The photoresist ashing residue comprises inorganic materials as main constituent and can be favorably dissolved in a solvent of water. It is desired that water is purified to a sufficient degree and contains metal ions in amounts of not larger than 10 ppb and, more preferably, not larger than 1 ppb. When an organic solvent is contained in the solvent, the solubility of the ashing residue decreases with an increase in the content of the organic solvent. It is therefore desired that the solvent contains substantially no organic solvent.

If necessary, the cleaning agent of the present invention may contain other surfactants such as an ethylene oxide adduct of alkyl ether and the like in addition to the above-mentioned amphoteric surfactant and fluorine-contained cationic surfactant. The cleaning agent may further contain a corrosion-preventing agent such as derivatives of sugars, condensation products thereof, etc., and a reducing agent or a defoaming agent such as quinolinol from the standpoint of preventing degeneration.

There can be used any known photoresist to which the photoresist ashing residue cleaning agent of the present invention can be applied without limitation. It is desired to use a photoresist for g-rays, i-rays, excimer rays, X-rays or electron rays used for the formation of semiconductor circuit patterns. Concrete examples of the resin include novolak resin and polyhydroxystyrene resin.

The photoresist ashing residue cleaning agent of the present invention is usually used for removing the ashing residue remaining on the treated surface after the photoresist developed on the substrate wafer is subjected to the ashing treatment. The effect contemplated by the present invention is markedly exhibited particularly when the cleaning agent of the present invention is used for the substrate that is dry-etched by the RIE or for the substrate subjected to the ion-implantation treatment, since the incompletely ashed product of photoresist and side-wall polymer have been much deposited on the ashed surfaces of these substrates.

Any known method of ashing the photoresist by generating oxygen radicals can be employed without limitation as the ashing treatment for the photoresist. For instance, either the batch system or the single wafer process system can be employed. Or, the ozone ashing system or the UV ozone ashing system can be employed without limitation. Concretely speaking, the batch system will be of the concentric type, and the condenser system and the single wafer process system will be of the high-frequency type or microwave type. Though there is no particular limitation on the substrate wafer, there is generally employed a silicon wafer or a glass wafer having an insulating layer such as $SiO_2$ layer or a layer of a low permittivity and an electrically conducting layer such as of Al, Cu, Si or an alloy thereof formed on the surface thereof.

The ashing-treated surface is cleaned by using the cleaning agent of the present invention, i.e., cleaned by immersing the treated surface in the cleaning agent or by spraying the cleaning agent onto the treated surface. In this case, there is no particular limitation on the temperature of the cleaning agent. The ability for removing the ashing residue is generally improved when the cleaning agent is used being heated causing, however, the underlying layer to be more corroded correspondingly and forcing the permissible cleaning time to be shortened. The temperature may be suitably set by taking the desired cleaning ability, corrosion-preventing action and operability into consideration. Usually, the cleaning agent is used over a temperature range of from 10 to 80° C. and, more preferably, from 20 to 50° C.

The cleaning agent of the present invention is capable of favorably removing the residue after the ashing treatment of the photoresist. In particular, the cleaning agent of the invention highly efficiently removes the side-wall polymer and the incompletely ashed product of photoresist, formed by the RIE. Yet, the cleaning agent of the invention corrodes very little the insulating layer or the electrically conducting layer on the substrate wafer.

The invention will now be described in further detail by way of Examples to which only, however, the invention is in no way limited.

Mentioned below are the products of surfactants used in Examples and in Comparative Examples.

1) Amphoteric surfactants

Amphoteric surfactant A.

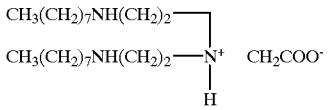

Amphoteric surfactant B.

Lauroylaminopropyldimethylbetaine

Amphoteric surfactant C.

Lauryldimethylbetaine

Amphoteric surfactant D.

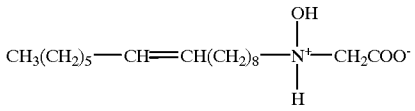

Amphoteric surfactant E.

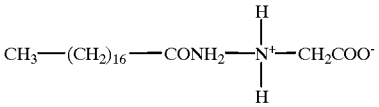

Amphoteric surfactant F.

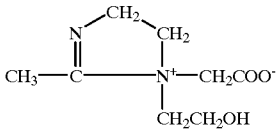

2) Fluorine-contained cationic surfactant.

"Ftargent FT-310" produced by Neos Co.

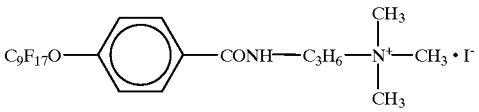

"Fluorad FC-135" produced by Sumitomo 3M Co.

Perfluoroalkyltrimethyl quaternary ammonium iodide

"Surflon S-121" produced by Sei Chemical Co.

Perfluoroalkyltrimethyl quaternary ammonium salt

"MEGAFAC F-150" produced by Dainippon Ink Co.

Perfluoroalkyltrimethyl quaternary ammonium salt

3) Other surfactant.

Dodecylammonium chloride

"Zondes TL" produced by Matsumoto Yushi Seiyaku Co.

In the following Examples and Comparative Examples, the testings were conducted according to the following methods.

1) Removal of the side-wall polymer.

Test pieces of silicon wafers were immersed in 30 ml of the photoresist ashing residue cleaning agent maintained at 23° C. for 10 minutes and were washed with water. The cleaned surfaces were observed through a scanning-type electron microscope at a magnification of 40,000 times and were judged on the basis of the following criteria:

◎: Completely dissolved and removed.

○: Almost dissolved and removed.

Δ: Partly remained undissolved.

X: Did not dissolve and could not be removed.

2) Removal of the incompletely ashed product of photoresist.

The cleaned surfaces of the test pieces immersed in the photoresist ashing residue cleaning agent were observed through the scanning-type electron microscope at a magnification of 40,000 times and were judged on the basis of the following criteria:

◎: Completely dissolved and removed.

○: Almost dissolved and removed.

Δ: Partly remained undissolved.

X: Did not dissolve and could not be removed.

3) Corrosion of Al layer.

Test pieces of silicon wafers were immersed in 30 ml of the photoresist ashing residue cleaning agent maintained at 23° C. for 10 minutes, and the amounts of elution of Al into the cleaning agent were measured relying on the high-frequency induction coupling plasma mass analysis (ICP-MS).

4) Permissible immersion time (at 23° C.).

Test pieces of silicon wafers were immersed in 30 ml of the photoresist ashing residue cleaning agent maintained at 23° C. A total of 25 testings were conducted by dividing the immersion time by an interval of one minute from the start of immersion until 25 minutes have passed. After cleaned for the above-mentioned immersion times, the test pieces were washed with water and the cleaned surfaces were observed through the scanning-type electron microscope of a magnification of 40,000 times. The immersion times of those test pieces which were evaluated to meet the criterion ◎, i.e., from which the side-wall polymer and the incompletely ashed product of photoresist were completely removed by dissolution, were found as minimum permissible times.

Corrosion of the Al layer wiring on the test pieces was also observed using the scanning-type electron microscope at a magnification of 40,000 times, and the immersion times of the test pieces from which even slightly corroded portions were observed were found as maximum permissible times. Measurement was taken concerning the elution of aluminum in the cleaning agent in which were immersed test pieces on which the corroded portions were observed relying on the high-frequency induction coupling plasma mass analysis (ICP-MS). The amounts of elusion were not smaller than 170 ppb.

The period from the thus found minimum permissible time to the maximum permissible time was regarded to be a permissible immersion time at 23° C.

5) Permissible immersion time (at 40° C.).

In the above-mentioned operation for measuring the immersion time at 23° C., the temperature of the cleaning agent was elevated to 40° C., and a total of 12 testings were conducted by dividing the immersion time at an interval of 10 seconds from the start of immersion until 2 minutes have passed. The period from the thus found minimum permissible time to the maximum permissible time was regarded to be a permissible immersion time at 40° C. (Examples 1 to 21 and Comparative Examples 1 to 6)

An i-ray positive-type resist of a commercially available novolak resin was applied maintaining a thickness of about 1 μm onto an 8-inch wafer on which an Al layer wiring has been formed, and was pre-baked. Then, the resist was irradiated with i-rays, baked before being developed, rinsed after developing, and was further post-baked. The sample was subjected to the RIE treatment in a $CF_4$ gas at about 300 eV. Thereafter, the used resist was ashed and removed by using a plasma reactor.

Test pieces each measuring 2 cm were cut out from the thus treated silicon wafer by using a diamond cutter. By using these test pieces, the photoresist ashing residue cleaning agents of compositions shown in Tables 1 and 2 were evaluated for their properties, i.e., evaluated for their abilities of removing side-wall polymer, removing incompletely ashed product of photoresist, corrosion to the Al layer and permissible immersion time (at 23° C.). Measurement of the photoresist ashing residue cleaning agents shown in Tables 1 and 2 relying on the ICP-MS showed that their metal ion contents were not larger than 10 ppb. The results were as shown in Tables 1 and 2. (Examples 22 and 23)

By using the test pieces cut out from the silicon wafer same as those used in Example 1, the photoresist ashing residue cleaning agents shown in Table 3 were evaluated for their permissible immersion times (at 40° C.). The results were as shown in Table 3.

TABLE 1

| | Composition of cleaning agent | | Removal of ashing residue | | | Permissible |
|---|---|---|---|---|---|---|
| Ex. | Designation | Amount | Side-wall polymer | Incomplete ash | Al corrosion | immersion time (min. 23° C.) |
| 1 | ammonium fluoride | 0.05 | ◎ | ◎ | 50 ppb or less | 10–12 |
| | amphoteric surfactant A | 0.50 | | | | |
| | water | 99.45 | | | | |
| 2 | ammonium fluoride | 0.03 | ◎ | ◎ | 50 ppb or less | 10–12 |
| | amphorteric surfactant A | 0.70 | | | | |
| | water | 99.27 | | | | |
| 3 | ammonium fluoride | 0.05 | ○ | ◎ | 50 ppb or less | 12–14 |
| | amphoteric surfactant A | 0.50 | | | | |
| | polyoxyethylenesorbitan oleate | 1.45 | | | | |
| | water | 98.00 | | | | |
| 4 | ammonium fluoride | 0.06 | ◎ | ◎ | 50 ppb or less | 10–12 |
| | amphoteric surfactant A | 0.02 | | | | |
| | water | 99.92 | | | | |
| 5 | ammonium fluoride | 0.06 | ◎ | ◎ | 50 ppb or less | 9–12 |
| | amphoteric surfactant A | 0.02 | | | | |
| | dodecylammonium chloride | 0.02 | | | | |
| | water | 99.90 | | | | |
| 6 | tetramethylammonium fluoride | 0.05 | ◎ | ◎ | 70 ppb | 9–11 |
| | amphoteric surfactant A | 0.02 | | | | |
| | water | 99.93 | | | | |
| 7 | ammonium fluoride | 0.05 | ◎ | ○ | 50 ppb or less | 11–12 |
| | amphoteric surfactant B | 0.50 | | | | |
| | water | 99.45 | | | | |
| 8 | ammonium fluoride | 0.06 | ◎ | ○ | 50 ppb or less | 11 |
| | amphoteric surfactant B | 0.02 | | | | |
| | water | 99.92 | | | | |
| 9 | ammonium fluoride | 0.06 | ◎ | ○ | 60 ppb | 11 |
| | amphoteric surfactant C | 0.02 | | | | |
| | water | 99.92 | | | | |
| 10 | ammonium fluoride | 0.06 | ◎ | ○ | 60 ppb | 11 |
| | amphoteric surfactant D | 0.02 | | | | |
| | water | 99.92 | | | | |
| 11 | ammonium fluoride | 0.06 | ◎ | ○ | 60 ppb | 11 |
| | amphoteric surfactant E | 0.02 | | | | |
| | water | 99.92 | | | | |
| 12 | ammonium fluoride | 0.06 | ◎ | ○ | 70 ppb | 11 |
| | amphoteric surfactant F | 0.02 | | | | |
| | water | 99.92 | | | | |
| 13 | ammonium fluoride | 0.06 | ◎ | ◎ | 50 ppb or less | 5–16 |
| | amphoteric surfactant A | 0.02 | | | | |
| | Ftargent FT-310 | 0.02 | | | | |
| | water | 99.90 | | | | |
| 14 | ammonium fluoride | 0.06 | ◎ | ◎ | 50 ppb or less | 10–18 |
| | amphoteric surfactant A | 0.10 | | | | |
| | Ftargent FT-310 | 0.04 | | | | |
| | water | 99.80 | | | | |
| 15 | ammonium fluoride | 0.06 | ◎ | ◎ | 50 ppb or less | 9–14 |
| | amphoteric surfactant A | 0.02 | | | | |
| | MEGAFAC F-150 | 0.02 | | | | |
| | water | 99.90 | | | | |
| 16 | ammonium fluoride | 0.06 | ◎ | ◎ | 50 ppb or less | 8–13 |
| | amphoteric surfactant A | 0.02 | | | | |
| | Surflon S-121 | 0.02 | | | | |
| | water | 99.90 | | | | |
| 17 | ammonium fluoride | 0.02 | ◎ | ○ | 50 ppb or less | 11–16 |
| | amphoteric surfactant B | 0.30 | | | | |
| | Fluorad FC-135 | 0.01 | | | | |
| | water | 99.67 | | | | |

TABLE 1-continued

| Ex. | Composition of cleaning agent: Designation | Amount | Removal of ashing residue: Side-wall polymer | Incomplete ash | Al corrosion | Permissible immersion time (min. 23° C.) |
|---|---|---|---|---|---|---|
| 18 | ammonium fluoride | 0.06 | | | 50 ppb | |
| | amphoteric surfactant C | 0.02 | ◎ | ◎ | or less | 9–14 |
| | Ftargent FT-310 | 0.02 | | | | |
| | water | 99.90 | | | | |
| 19 | ammonium fluoride | 0.06 | | | 50 ppb | |
| | amphoteric surfactant D | 0.02 | ◎ | ◎ | or less | 9–14 |
| | Ftargent FT-310 | 0.02 | | | | |
| | water | 99.90 | | | | |
| 20 | ammonium fluoride | 0.06 | | | 50 ppb | |
| | amphoteric surfactant E | 0.02 | ◎ | ◎ | or less | 9–14 |
| | Ftargent FT-310 | 0.02 | | | | |
| | water | 99.90 | | | | |
| 21 | ammonium fluoride | 0.06 | | | 50 ppb | |
| | amphoteric surfactant F | 0.02 | ◎ | ◎ | or less | 9–13 |
| | Ftargent FT-310 | 0.02 | | | | |
| | water | 99.90 | | | | |

TABLE 2

| Ex. | Composition of cleaning agent: Designation | Amount | Removal of ashing residue: Side-wall polymer | Incomplete ash | Al corrosion | Permissible immersion time (min. 23° C.) |
|---|---|---|---|---|---|---|
| 1 | o-dichlorobenzene | 49.00 | | | 50 ppb | |
| | polyoxyethylenenonylphenylether | 49.00 | × | × | or less | — |
| | perfluoroethylene oxide adduct | 2.00 | | | | |
| 2 | ammonium fluoride | 0.05 | | | 50 ppb | |
| | dimethyl sulfoxide | 86.00 | × | Δ | or less | — |
| | water | 13.95 | | | | |
| 3 | ammonium fluoride | 0.05 | | | 50 ppb | |
| | dimethyl sulfoxide | 86.00 | × | Δ | or less | — |
| | catechol | 10.00 | | | | |
| | water | 3.95 | | | | |
| 4 | ammonium fluoride | 0.05 | | | | |
| | water | 99.95 | ◎ | ◎ | 180 ppb | — |
| 5 | ammonium fluoride | 0.05 | | | | |
| | tetraethylammonium bromide | 0.50 | Δ | Δ | 80 ppb | — |
| | water | 94.95 | | | | |
| 6 | amphoteric surfactant A | 1.00 | | | 50 ppb | |
| | water | 99.00 | × | × | or less | — |

TABLE 3

| | Composition of cleaning agent: Designation | Amount | Permissible immersion time (sec. 40° C.) |
|---|---|---|---|
| Example 22 | ammonium fluoride | 0.30 | |
| | amphoteric surfactant A | 0.03 | 50–60 |
| | water | 99.67 | |
| Example 23 | ammonium fluoride | 0.30 | |
| | amphoteric surfactant A | 0.03 | 40–90 |
| | Ftargent FT-310 | 0.03 | |
| | water | 99.64 | |

What is claimed is:

1. A photoresist ashing residue cleaning agent comprising an aqueous solution containing:

(a) an ammonium fluoride compound; and (b) an amphoteric surfactant of which the cationic group is an ammonium salt and of which the anionic group is a carboxylate.

2. A photoresist ashing residue cleaning agent according to claim 1, wherein the ammonium fluoride compound (a) is an ammonium fluoride.

3. A photoresist ashing residue cleaning agent according to claim 1 or 2, wherein the amphoteric surfactant (b) is a compound represented by the general formula (I),

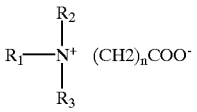

wherein $R_1$, $R_2$ and $R_3$ are, independently from each other, hydrogen atoms, hydrophobic groups, hydroxyl groups or amino groups, at least one of $R_1$, $R_2$ and $R_3$ is a hydrophobic group, and when two or more of $R_1$, $R_2$ and $R_3$ are hydrophobic groups, the hydrophobic groups may be bonded to each other to form a ring, and n is an integer of from 1 to 3.

4. A photoresist ashing residue cleaning agent according to claim 3, wherein in the compound represented by the general formula (I), the hydrophobic groups are alkyl groups having 1 to 20 carbon atoms, alkenyl groups having 1 to 20 carbon atoms, acylamino groups having 1 to 20 carbon atoms, acylaminoalkyl groups having 2 to 30 carbon atoms or alkylaminoalkyl groups having 2 to 30 carbon atoms.

5. A photoresist ashing residue cleaning agent according to claim 4, wherein in the compound represented by the general formula (I), at least one of $R_1$, $R_2$ and $R_3$ is a strongly hydrophobic group having not less than 5 carbon atoms.

6. A photoresist ashing residue cleaning agent according to claim 3, wherein the compound represented by the general formula (I) is,

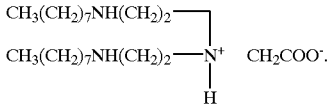

7. A photoresist ashing residue cleaning agent according to claim 1, wherein the concentration of the ammonium fluoride compound (a) is from 0.005 to 1% by weight, and the concentration of the amphoteric surfactant (b) is from 0.005 to 1.5% by weight.

8. A photoresist ashing residue cleaning agent according to claim 1, which is further blended with (c) a fluorine-contained cationic surfactant.

9. A photoresist ashing residue cleaning agent according to claim 8, wherein the fluorine-contained cationic surfactant (c) is a quaternary ammonium salt.

10. A photoresist ashing residue cleaning agent according to claim 9, wherein the fluorine-contained cationic surfactant (c) is represented by the general formula (II), (II)

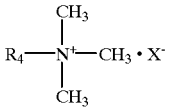

wherein R4 is a perfluoroalkyl group, and X- is an anion, or by the general formula (III),

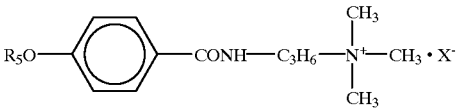

wherein $R_5$ is the same as $R_4$, and X- is an anion.

11. A photoresist ashing residue cleaning agent according to claim 8, wherein the concentration of the fluorine-contained cationic surfactant (c) is from 0.005 to 0.5% by weight.

12. A method of cleaning photoresist ashing residue by bringing the ashed photoresist into contact with an aqueous solution containing:

(a) an ammonium fluoride compound; and (b) an amphoteric surfactant of which the cationic group is an ammonium salt and of which the anionic group is a carboxylate.

* * * * *